US007018150B2

(12) United States Patent
Kim

(10) Patent No.: US 7,018,150 B2
(45) Date of Patent: Mar. 28, 2006

(54) CONTAINER FOR SHIP CAPABLE OF HEIGHT ADJUSTMENT

(76) Inventor: Jum Gyu Kim, 1308-306 Mokdong Apt. 13 Danji, Shinjeong6-dong, Yangcheon-gu, Seoul (KR)

( * ) Notice: Subject to any disclaimer, the term of this patent is extended or adjusted under 35 U.S.C. 154(b) by 0 days.

(21) Appl. No.: 10/470,963

(22) PCT Filed: Feb. 8, 2002

(86) PCT No.: PCT/KR02/00214

§ 371 (c)(1),
(2), (4) Date: Aug. 1, 2003

(87) PCT Pub. No.: WO02/064455

PCT Pub. Date: Aug. 22, 2002

(65) Prior Publication Data

US 2004/0067118 A1 Apr. 8, 2004

(30) Foreign Application Priority Data

Feb. 9, 2001 (KR) ..... 2001-6499
Dec. 29, 2001 (KR) ..... 2001-88154

(51) Int. Cl.
*B65D 6/16* (2006.01)

(52) U.S. Cl. ..... 410/46; 220/1.5; 220/6; 108/55.1; 108/56.1

(58) Field of Classification Search ..... 410/46; 220/1.5, 4.28, 6, 8; 108/55.1, 53.1, 56.1, 108/147.19, 147.2; 206/386, 600; 414/498; 248/346.3
See application file for complete search history.

(56) References Cited

U.S. PATENT DOCUMENTS 2,523,271 A * 9/1950 Bartel ..... 108/55.3
3,807,581 A * 4/1974 Nichols ..... 206/600
4,966,085 A * 10/1990 Howe ..... 108/55.1
4,986,705 A * 1/1991 Durkin ..... 410/57
6,227,397 B1 * 5/2001 Kim ..... 220/8
6,513,442 B1 * 2/2003 Miller et al. ..... 108/53.1

(Continued)

FOREIGN PATENT DOCUMENTS

WO WO 00/69756 * 11/2000

*Primary Examiner*—Stephen Gordon
(74) *Attorney, Agent, or Firm*—Gottlieb, Rackman & Reisman

(57) ABSTRACT

In a container for a ship capable of adjusting height thereof, a mobile post capable of adjusting its height is more firmly supported with a simple structure. A container for a ship capable of adjusting height thereof includes a bottom plate on which goods are placed, a wall plate installed to erect at one side of the bottom plate, a fixed post installed at the wall plate, a mobile post installed at the fixed post and capable of ascending and descending by being guide by the fixed post over a predetermined length with respect to the fixed post, and a support bar having one end portion hinge-coupled to the mobile post and the other end portion fixed to the wall plate to support the mobile post at an angle. Thus, the strength of the mobile post is reinforced when the mobile post ascends; a load concentrating on the mobile post is distributed by the inclined structure so that a firm support is possible; durability of a product can be improved; by forming the key protrusion on the pin, more firm fixing and easy use are made possible; when the mobile post is completed lowered, the support bars are folded and included so that the volume of the support bars is minimized; and automatic ascending and descending of the mobile post is possible.

6 Claims, 11 Drawing Sheets

U.S. PATENT DOCUMENTS 6,602,032 B1 * 8/2003 Arai ..... 410/46
6,655,300 B1 * 12/2003 Clive-Smith et al. ..... 108/53.5
6,726,416 B1 * 4/2004 Shoup ..... 410/46
6,814,529 B1 * 11/2004 Junge ..... 410/46

* cited by examiner

CONTAINER FOR SHIP CAPABLE OF HEIGHT ADJUSTMENT

BACKGROUND OF THE INVENTION

1. Field of the Invention

The present invention relates to a container for a ship capable of adjusting height thereof, and more particularly, to a container for a ship capable of adjusting height thereof in which a mobile post capable of adjusting its height is more firmly supported with a simple structure and simultaneously the height of the mobile posts can be fixed.

2. Description of the Related Art

In general, a container for a ship is widely used as a device for holding goods in water transportation. The container for a ship has a space inside to hold goods and is referred to as a transportation equipment having a box shape manufactured according to a set specification to be used with interlink with at least one transportation method.

The containers can be accumulated on a ship so that a large quantity of goods can be transported. Also, the container is widely used because it is counted as a unit of delivery during loading or unloading work.

However, since a conventional container for a ship cannot adjust its height, when goods having height over the height of the container is loaded, the container must be placed on the top layer of the stacked containers because other containers cannot be stacked thereon, or an additional fee must be paid for an unused space above the over-height container.

To solve the above problem a container for a ship capable of adjusting its height by installed a mobile post that can be raised or lowered at a fixed post has been developed. However, the conventional height adjustable container has a problem that the mobile post having a limited strength according to a general specification cannot endure several or tens of tons concentrated thereon, which prevents realization of the container.

Also, since a load is concentrated on a pin for fixing the height by penetrating the mobile post and a pinhole, the pin is easily damaged.

SUMMARY OF THE INVENTION

To solve the above problems, it is an object of the present invention to provide a container for a ship capable of adjusting height thereof in which a strength of a mobile post is reinforced when the mobile post is raised, a load concentrated on the mobile post is distributed by an inclined structure so that the mobile pos can be more firmly supported, and durability of the container can be improved.

It is another object of the present invention to provide a container for a ship capable of adjusting height thereof in which a pin is installed at a support bar to prevent a load overly acting on the pin and a pinhole for fixing the height, and a key protrusion is formed on the pin to enable firm fixing and facilitate an easy use thereof.

It is another object of the present invention to provide a container for a ship capable of adjusting height thereof in which, when the mobile post is completely lowered, a volume occupied by the support bar that is included and folded can be minimized.

It is another object of the present invention to provide a container for a ship capable of adjusting height thereof in which the mobile post can be automatically lifted.

To achieve the above objects, there is provided a container for a ship capable of adjusting height thereof comprising a bottom plate on which goods are placed, a wall plate installed to erect at one side of the bottom plate, a fixed post installed at the wall plate, a mobile post installed at the fixed post and capable of ascending and descending by being guide by the fixed post over a predetermined length with respect to the fixed post, and a support bar having one end portion hinge-coupled to the mobile post and the other end portion fixed to the wall plate to support the mobile post at an angle.

It is preferred in the present invention that the one end portion of the support bar is hinge-coupled to a corner cast of each of the fixed posts installed at the left and right sides of the wall plate at one side of the bottom plate and the other end portion is hinge-coupled b a pin penetrating one of a plurality of pinholes formed in both fixed plates horizontally formed on an upper surface of the wall plate parallel to each other, so that the fixed posts are supported and fixed as a pair of the support bars, supporting the mobile posts and facing each other, cross in form of "V" or "X".

It is preferred in the present invention that the mobile post is completely lowered, the support bars are folded parallel to each other to be included between both fixed plates.

It is preferred in the present invention that an actuator is installed at the other end portion of each he support bar so that the mobile post is automatically ascends or descends as the position of the other end portion of the support bar changes.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

A container for a ship capable of adjusting height thereof according to a preferred embodiment of the present invention will be described in detail with reference to the accompanying drawings.

Figure 1:
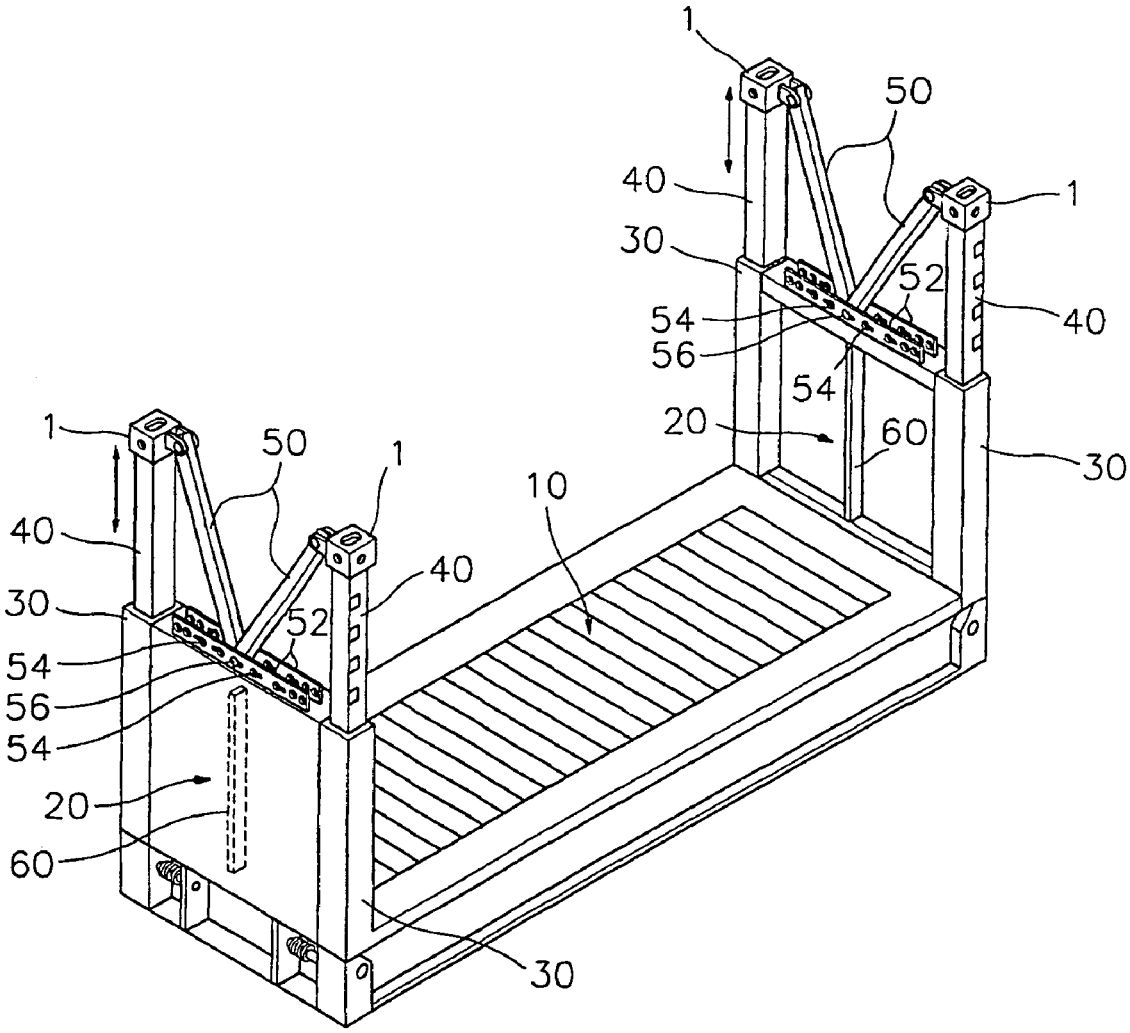
FIG. 1 is a perspective view showing a container for a ship capable of adjusting height thereof according to a preferred embodiment of the present invention.

First, as shown in FIG. 1, a container for a ship capable of adjusting height thereof according to a preferred embodiment of the present invention is a flat lock container for a ship having open upper and lateral sides and includes a bottom plate 10, a wall plate 20, a fixed post 30, a mobile post 40, and a support bar 50.

Here, the bottom plate 10 is a flat plate having an iron frame on which goods are placed. Also, the wall plate 20 is a flat plate having an iron frame that is hinge-coupled to the bottom plate 10 so that it is completely folded onto the bottom plate 10 or erected upright with respect to the bottom plate 10.

The fixed post 30 is box-shaped and installed both sides of the wall plate 20. The mobile post 40 is inserted into the fixed post 30 and slides and moves up and down therein. The mobile post 40 having a bar shape is inserted in the fixed post 30 and guided by the fixed post 30 so that it can freely move up and down over a predetermined height.

The support bar 50 of the present invention has one side end portion hinge-coupled to the mobile post 40 for supporting the mobile post 40 at an angle and the other end portion fixed to the wall plate 20. The one end portion of the support bar 50 is hinge-coupled to a corner cast 1 of each of the mobile post 40 and the other end portion thereof is hinge-coupled by a pin 56 penetrating one of a plurality of pinholes 54 of both fixed plates 52 horizontally formed in parallel on the upper surface of the wall plate 20.

Figure 2:
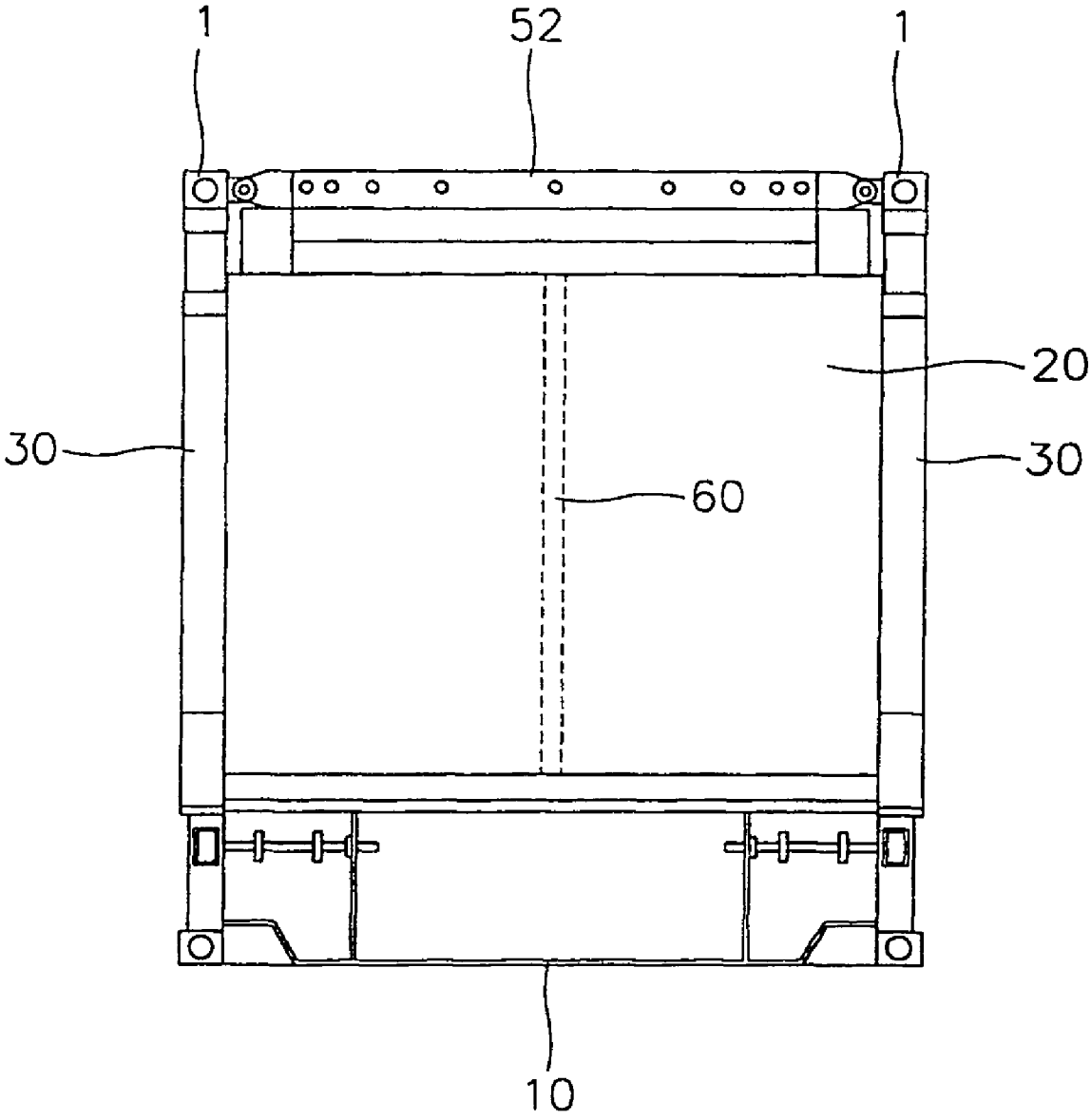
FIGS. 2 through 4 are side views showing the operation of the container of FIG. 1, step by step.
Figure 3:
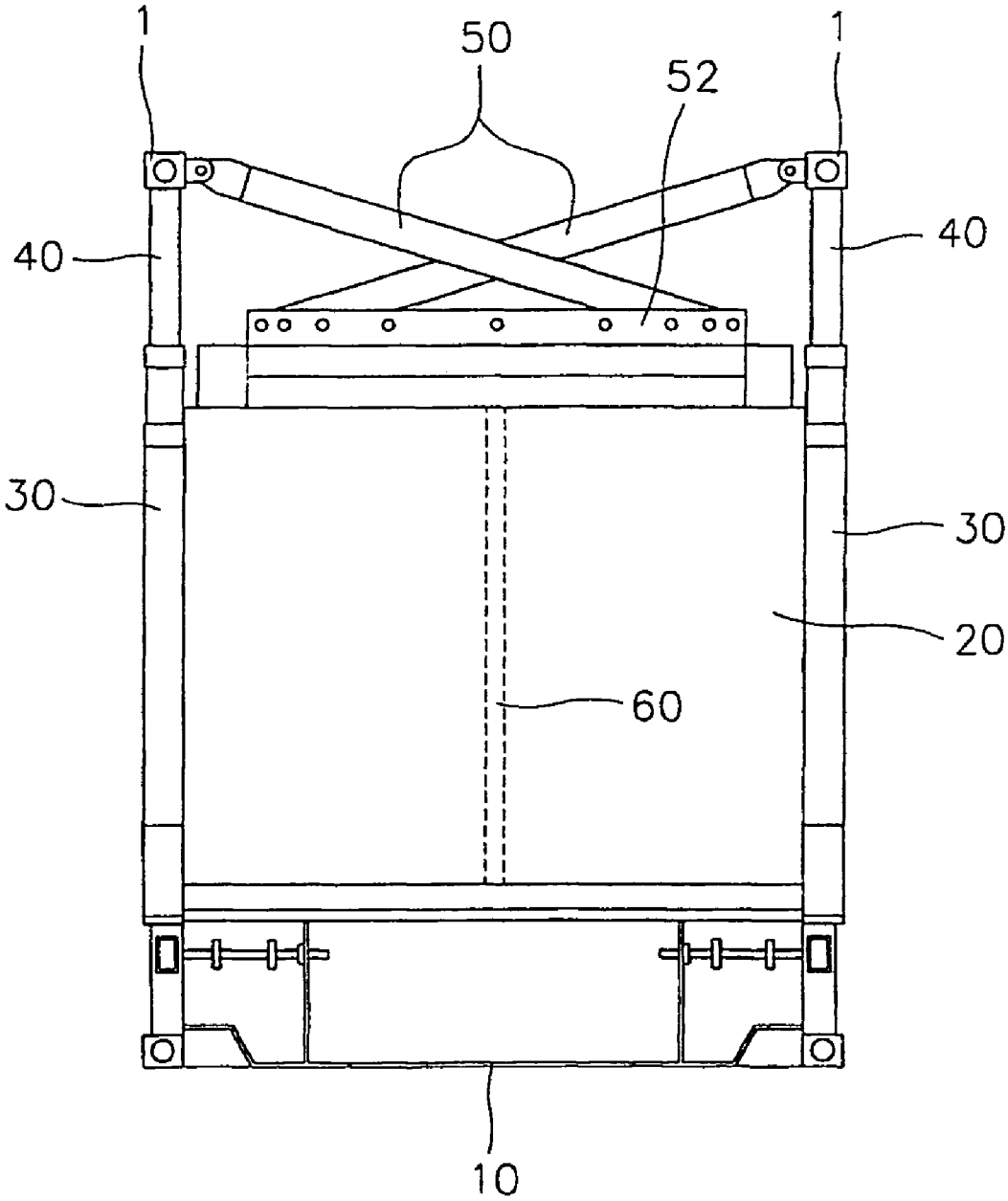
Figure 4:
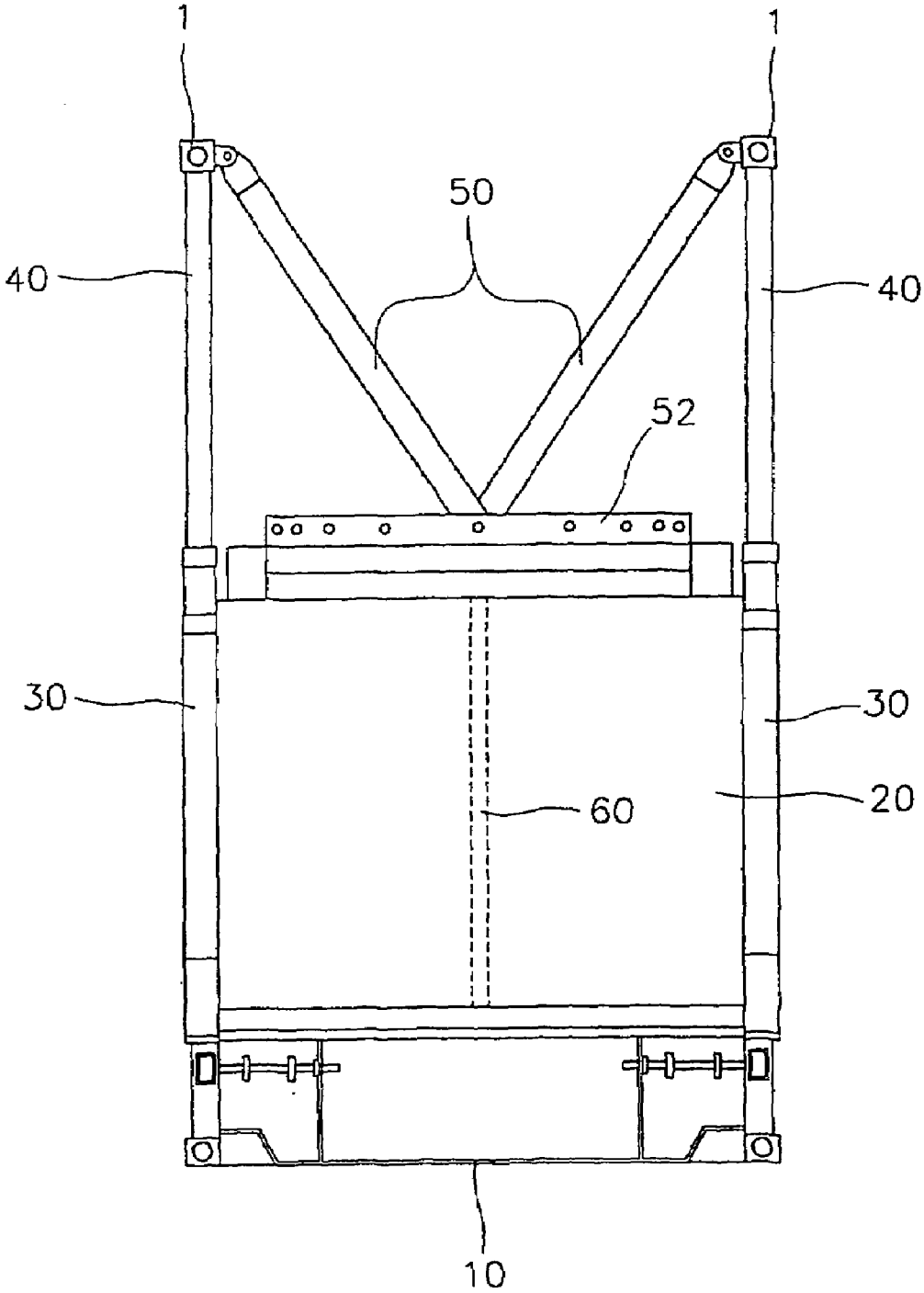

Here, as shown in FIG. 2, when the mobile post 40 is completely lowered, both support bars 50 reclines horizontally in form of "11" to be included between both fixed plates 52. When the mobile post 40 ascends to the middle height, as shown in FIG. 3, both support bars 50 cross in form of "X" to support and fix the both fixed posts 30. When the mobile post 40 is completely lifted, as shown in FIG. 4, both support bars 50 cross in form of "V" to support both fixed posts 30 at an angle.

Figure 7:
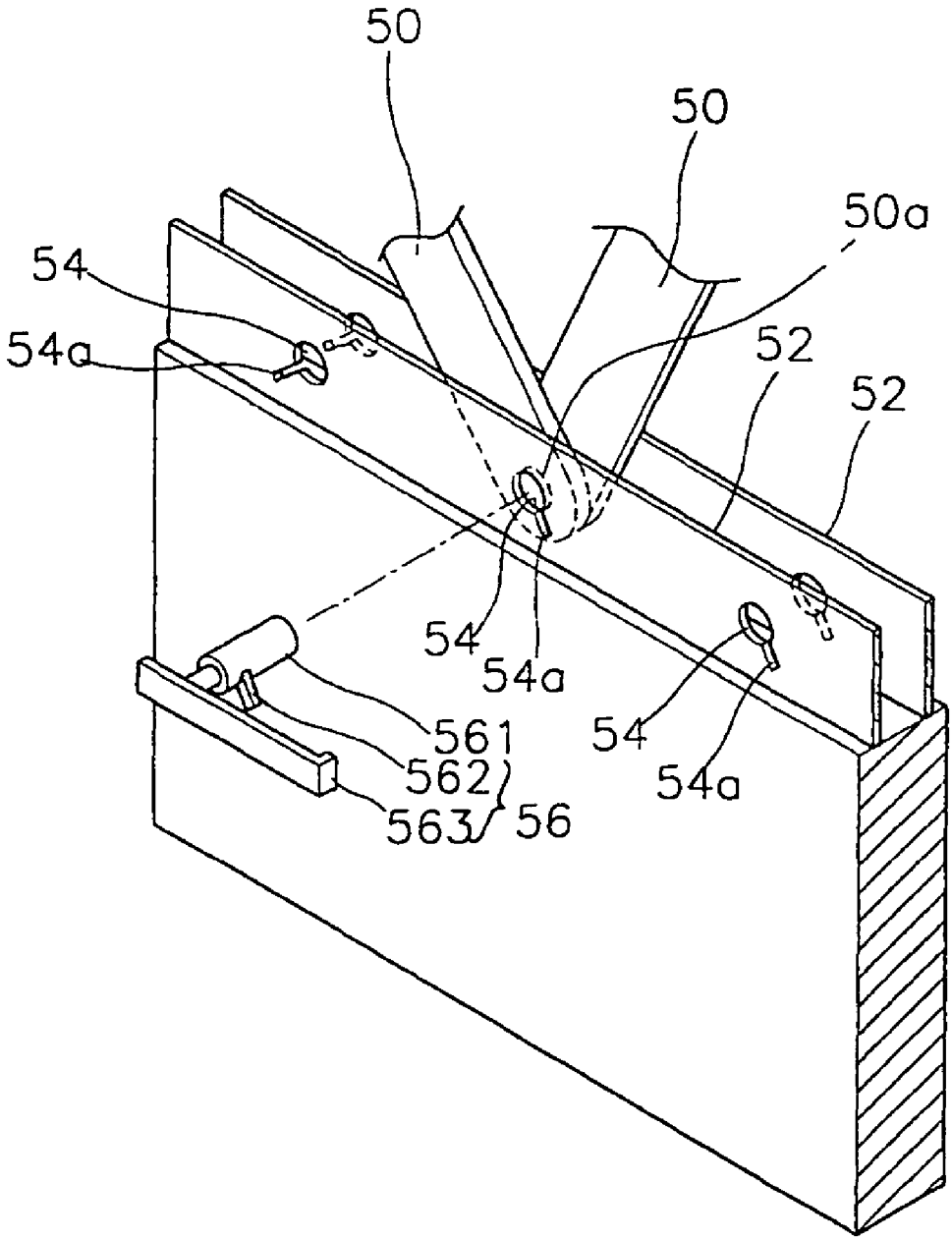
FIG. 7 is an exploded perspective view showing the pin of FIG. 1.

The pinholes 54, as shown in FIG. 7, are formed parallel to the fixed plates 52 according to the height that the mobile post 40 ascends. A key groove 54*a* for fixing the pin 56 inserted therein is formed at one side of each pinhole 54.

Here, as shown in FIG. 7, the pin 56 includes a pin column 561, a key protrusion 562, and a rotational handle 563. The pin column 561 has a shape of a cylinder to be inserted into the pinhole 54. The key protrusion 562 is formed at the side of the pin column 561 and has a shape corresponding to the key groove 54*a* formed in the fixed plates 52. The rotational handle 563 is formed perpendicular to one end portion of the pin column 561.

Thus, when the pin 56 is inserted into the pinhole 54, a worker holding the rotational handle 563 rotates the pin column 561 together with the key protrusion 562, such that the key protrusion 562 fits to the key groove 54*a* formed in the pinhole 54, and inserts the pin 56 into the pinhole 54. When the pin column 561 is completely inserted into the pinhole 54, the rotational handle 563 is rotated so that the pin 56 does not escape from the pinhole 54. Accordingly, the key protrusion 562 is locked to the key groove 54*a* so that the pin 56 does not escape therefrom.

Then, when the pin 56 is drawn from the pinhole 54, the pin column 561 is rotated together with the key protrusion 562 by the rotational handle 563 until the key protrusion 562 fits to the key groove 54*a*, so that the pin 56 can be drawn.

Here, the key groove 54*a* formed in the pinhole 54 to be inclined at an angle with respect to a direction of gravity (downward). Accordingly, as the rotational handle 563 and the key protrusion 562 of the pin 56 inserted into the pinhole 54 normally face downward due to their weight, the key protrusion 562 is preferably deviated from the key groove 54*a* and fixed thereby.

Fixing means having a variety of types and shapes can be used as the pin 56 and the pinhole 54 for fixing the support bars 50. Technologies on the fixing means are well known and can be easily modified by those skilled in the art.

Figure 5:
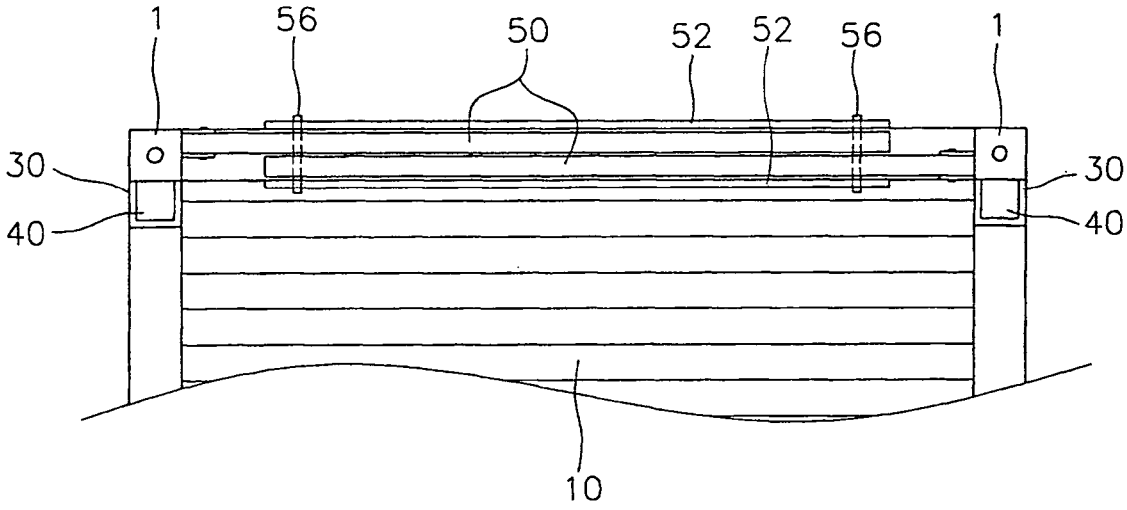
FIG. 5 is a plan view of the container by magnifying a portion of support bars of FIG. 2.

As shown in FIGS. 2 and 5, when the mobile post 40 is completely lowered, the support bars 50 according to the present invention are folded to be included between both fixed plates 52 and reclined in form of "11" parallel to each other. Here, each of the support bars 50 is fixed by the pin 56 inserted into the pinhole 54 that is formed farthest from the center in the fixed plates 52. Thus, when the mobile post 40 is completely lowered, volume occupied by the support bars 50 that is folded and included can be minimized.

Figure 6:
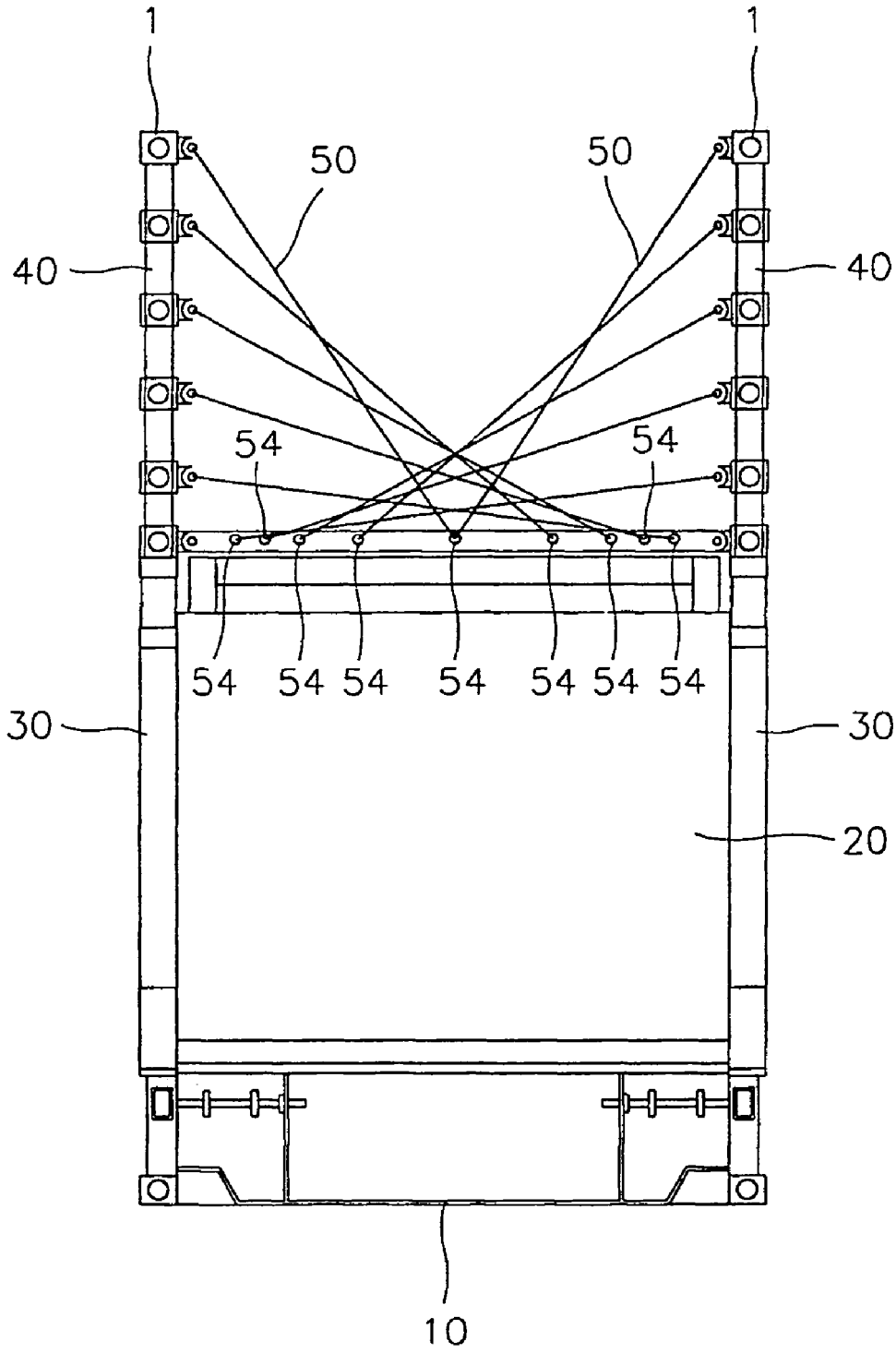
FIG. 6 is a side view showing the interval of pinholes in a fixed plate of FIG. 1.

As shown in FIG. 6, the pinhole 54 is formed at several positions in the fixed plates 52 according to the height of elevation of the mobile post 40. To control the height of the mobile post 40 with the same interval, the interval between the pinholes 54 is greater in the central portion of the fixed plate 52 and narrower at the both end portions of the fixed plates 52.

As shown in FIGS. 1 through 5, a reinforcement member 60 for vertically supporting the center of the wall plate 20 may be further installed to distribute a force concentrated on the central portion of the fixed plate 52. Since the types and shapes of the reinforcement member 60 are various, modification thereof can be easily done by those skilled in the art.

An actuator including a hydraulic cylinder or motor can be installed at the other end portion of the support bar 50 that is fixed at the wall plate 20 so that the mobile post 40 is automatically moved up and down as the position of the other end portion changes. That is, although not shown, a rail can be formed on the upper surface of the wall plate 20 so that the other end portion of the support bar 50 can slide on the rail, and a screw rod that is moved back and forth by a hydraulic cylinder or a motor is installed at the other end portion of the support bar 50, so that the mobile post 40 can automatically move up and down by an angle of the support bar 50.

Since the technology about the actuator is well known and already commercialized, those skilled in the art can modify the actuator within a range of technical concept of the present invention.

Thus, in the container for a ship capable of adjusting height thereof according to the present invention, the support bars 50 are normally kept in form of "11" to minimize its volume, as shown in FIG. 2. When the size of goods is greater than the height of the wall plate 20, the mobile post 40 is raised and the pin 56 is inserted into the pinhole 54 and a through hole (50*a*) formed in the other end portion of the support bar 50. Accordingly, the support bar 50 is fixed in form of "X" or "V" and the mobile post 40 is firmly fixed.

Thus, when goods having heights over the height of the container are to be loaded, the mobile post 40 is raised over the height of the goods so that other containers can be stacked above the container, thus reducing an additional transportation cost much.

Also, since a thrust structure (a triangle structure) can bear a load of several or tens of tons acting on the mobile post 40, strength and durability of a product are greatly improved. A load concentrated on the pin 56 and the pinhole 54 is distributed to the mobile post 40 so that durability of parts can be improved.

The container for a ship capable of adjusting height thereof according to the present invention, as shown in FIGS. 8 through 11, an actuator (not shown) for lifting or reclining the fixed post 30 and the wall plate 20 with respect to the bottom plate 10 is installed to reduce space needed for keeping the fixed post 30 and the wall plate 20.

That is, the fixed post 30 and the wall late 20 are installed to be hinge-coupled to be folded onto the bottom plate 10. The actuator erects or reclines the fixed post 20 and the wall plate 20 between the fixed post 30 and the bottom plate 10. Although a variety of actuators having different types and shapes can be installed, preferably, a hydraulic actuator 70 shown in FIGS. 8 through 11, or a mechanical actuator 80 shown in FIGS. 12 and 13, can be installed.

Here, the hydraulic actuator 70 includes a hydraulic jack 72 and a pressing rod 74. The hydraulic actuator 70 is fixed to the bottom plate 10. The piston 10 is extended or contracted as a detachable lever 71 is moved up and down so that working oil is pumped into a cylinder and the piston 73 is elevated by a hydraulic force.

Also, the pressing rod 74 is a link assembly which has one end portion hinge-coupled to the bottom plate 10 using the rule of a lever, a middle portion hinge-coupled to one end of the piston 73, and the other end portion contacting the fixed post 30. When the piston 73 expands, the other end portion of the pressing rod 74 presses the fixed post 30 to erect the fixed post 30.

Figure 8:
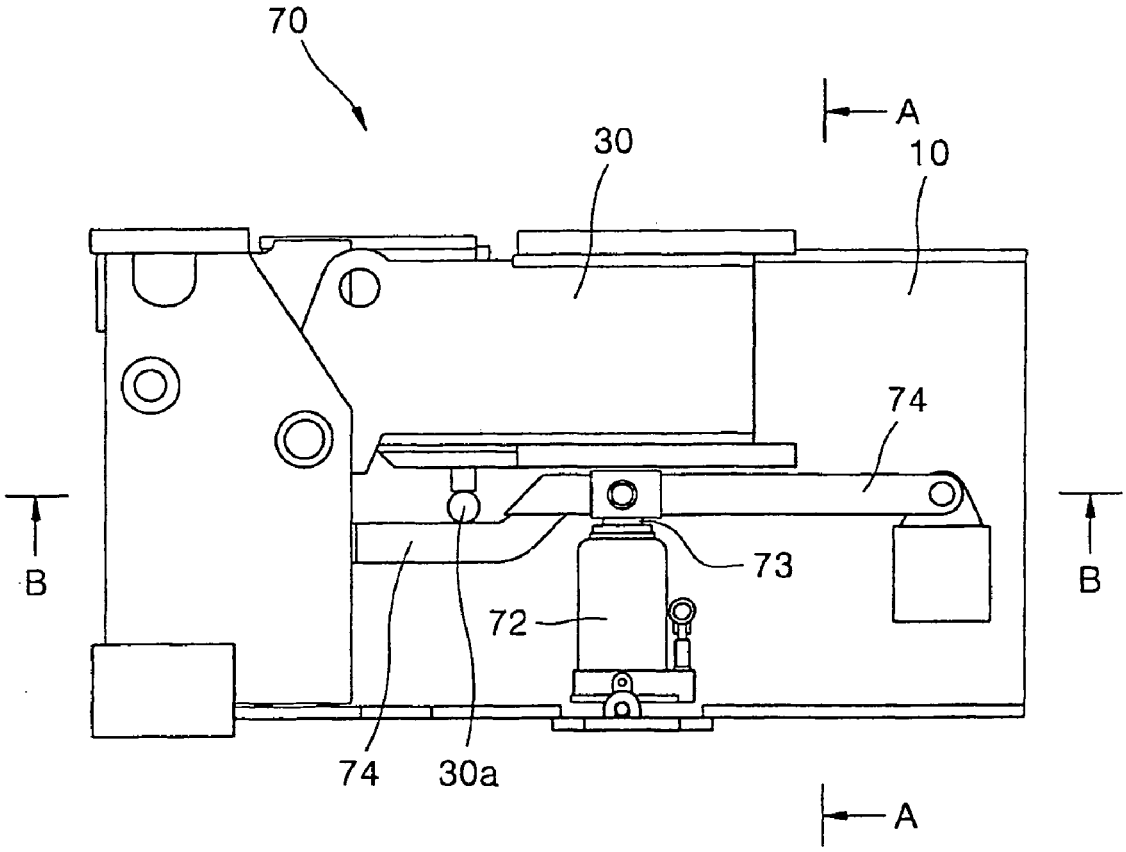
FIG. 8 is a front view showing the state in which a piston of an actuator installed between fixed posts and a bottom plate for lifting or reclining the fixed posts and wall plates is compressed.
Figure 9:
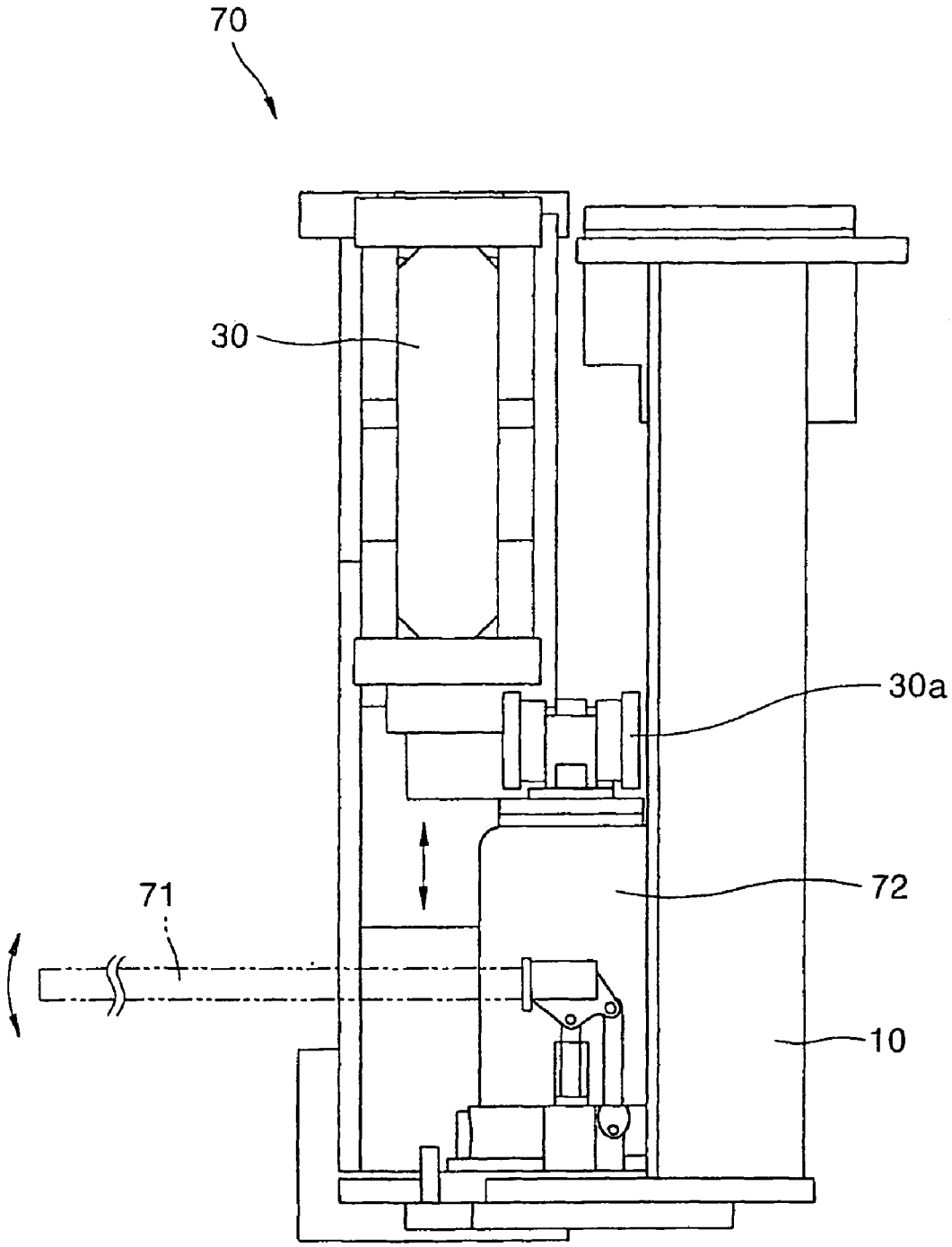
FIG. 9 is a sectional view taken along line A—A of FIG. 8.
Figure 10:
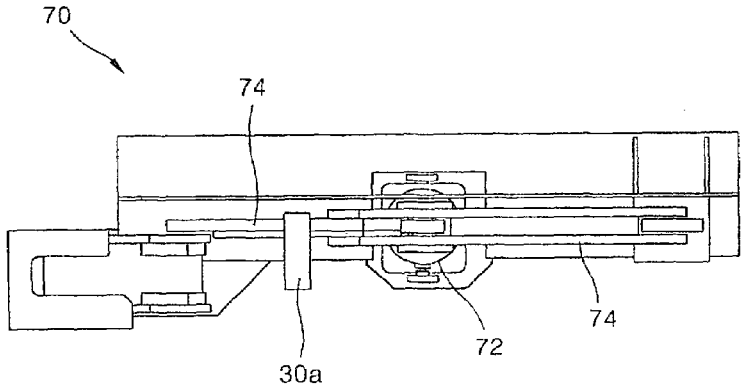
FIG. 10 is a sectional view taken along line B—B of FIG. 8.
Figure 11:
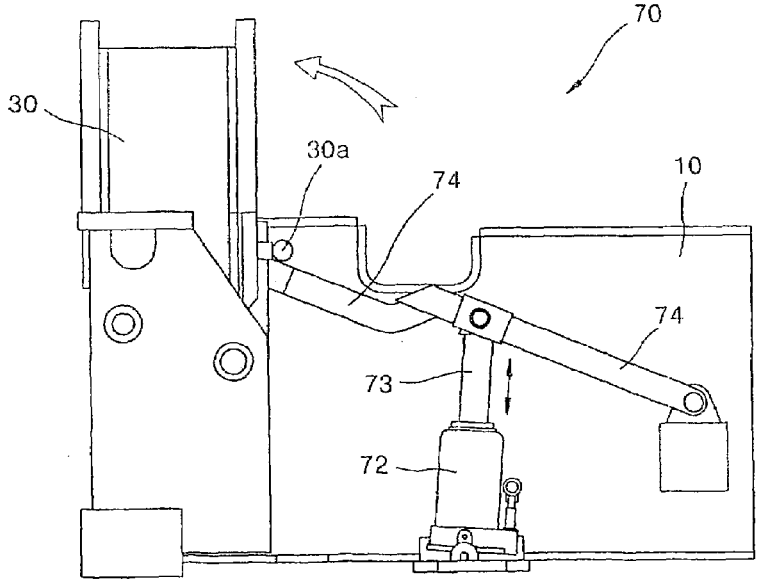
FIG. 11 is a front view showing a state in which the piston of the actuator extends.

Thus, to erect the fixed post 30, the hydraulic jack 72 is pumped by using the detachable lever 71 inserted into the hydraulic jack 72 shown in FIGS. 8 and 9, so that the piston 73 expands. When the piston 73 extends and presses the middle portion of the pressing rod 74, the other end portion of the pressing rod 74 presses a round protrusion 30*a* of the fixed protrusion 30 according to the rule of a lever because the one end portion of the pressing rod 74 is hinge-coupled. Thus, the fixed post 30 can be vertically erected, as shown in FIG. 11.

Also, to recline the erected fixed post 30, a pressure exhaust valve (not shown) is open to decrease pressure in the cylinder of the hydraulic jack 72 so that the fixed post 30 is gradually reclined.

The above actuator can be configured with a variety of types and forms. A mechanical actuator 80, as shown in FIGS. 12 and 13, can be used to accurately control the erection and folding operation of the fixed post by rotating a rotational shaft 81 in a forward or reverse direction.

Figure 12:
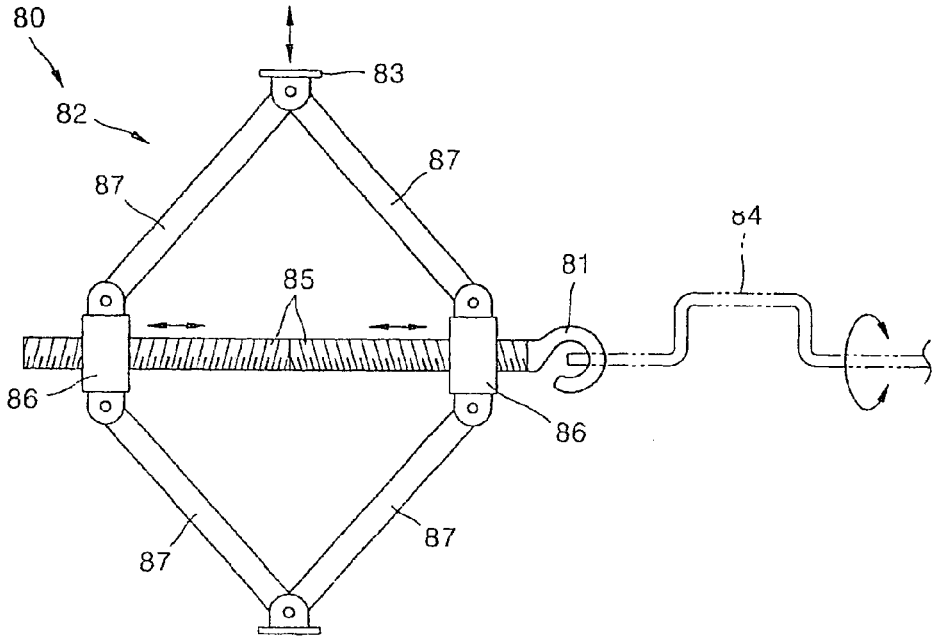
FIG. 12 is a view showing another preferred embodiment of the actuator of FIG. 8.

That is, as shown in FIG. 12, the mechanical actuator 80 includes a mechanical jack 82 and the pressing rod 74 of FIG. 8. The mechanical jack 82 is fixed at the bottom plate 10 and a jack end portion 83 is extended and contracted by means of the forward/reverse directional rotation of the rotational shaft 81.

As an example of the mechanical jack, as shown in FIG. 12, a screw type jack may be used which extends or contracts the jack end portion 83 by means of a mobile portion 86 reciprocating to face each other along a double screw rod 85 connected to a detachable rotating rod 84 and a link rod 87 link-coupled to the mobile potion 86.

Figure 13:
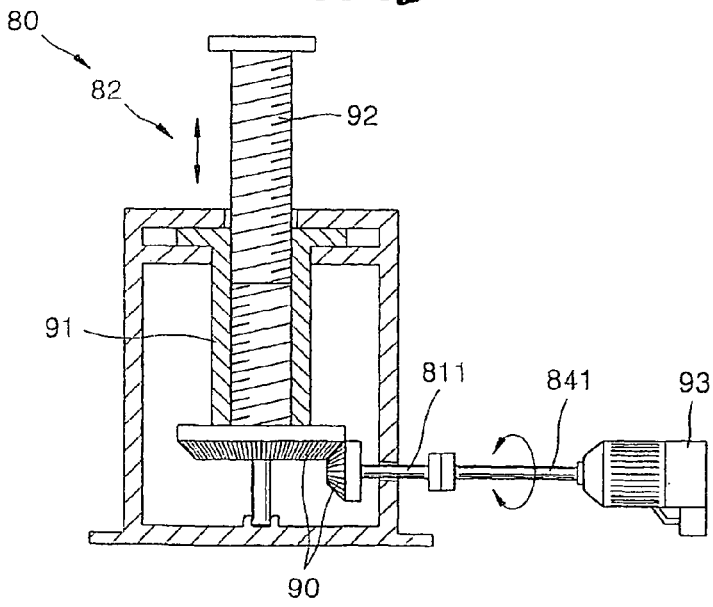
FIG. 13 is a view showing yet another preferred embodiment of the actuator of FIG. 8.

Also, a gear type jack, as shown in FIG. 13, may be used as another example of the mechanical jack 82. In the gear type jack, a forward/reverse rotational motion of the rotational shaft 811 connected to a detachable rotational rod 841 is converted to a rotational motion to a boss 91 by using a bevel gear assembly 90. Thus, a mobile screw 92 screw-coupled to a boss 91 extends or contracts as moving up and down according to the rotation of the boss 91.

Thus, by manually rotating the detachable rotational rod 841 in a forward/reverse direction or by connecting it to an automatic motor 93 to be selectively rotated in a forward/reverse direction, the fixed post 30 is erected or folded and simultaneously a folding angle or speed can be freely controlled. When the rotational shaft 811 is not rotated, since the fixed post 30 maintains a folding state as is, a damage to a worker due to an abrupt falling of the fixed post 30 can be prevented.

It is obvious that the present invention is not limited to the above-described preferred embodiment and can be modified by those skilled in the art within a range of a technical concept of the present invention.

For example, although in the above-described preferred embodiment the present invention is applied to a flat lock container for a ship, the present invention can be applied to all other containers. Also, the pin and pinhole are used as a fixing means in the above preferred embodiment, other various fixing means can be used for this purpose.

Thus, the scope of claiming the right in the present invention must be defined by the following claims and technical concepts thereof, not within the scope of the above detailed specification.

As described above, in the container for a ship capable of adjusting height thereof according to the present invention, the strength of the mobile post is reinforced when the mobile post ascends; a load concentrating on the mobile post is distributed by the inclined structure so that a firm support is possible; durability of a product can be improved; by forming the key protrusion on the pin, more firm fixing and easy use are made possible; when the mobile post is completed lowered, the support bars are folded and included so that the volume of the support bars is minimized; and automatic ascending and descending of the mobile post is possible.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A container for a ship, said container capable of adjusting its height and comprising:

a bottom plate on which goods are placed;

a wall plate installed to erect on the bottom plate at one side;

a fixed post installed at the wall plate;

a mobile post installed at the fixed post and capable of ascending and descending by being guided by the fixed post over a predetermined length with respect to the fixed post; and a support bar having one end portion hinge-coupled to the mobile post and another end portion fixed to the wall plate to support the mobile post at an angle;

wherein the one end portion of the support bar is hinge-coupled to a corner cast of the mobile post and said another end portion is hinge-coupled by a pin penetrating one of a plurality of pin holes formed in a fixed plate disposed along an upper surface of the wall plate; and wherein the pinholes are formed according to the height that the mobile post ascends or descends to and a key groove formed at one side of each pinhole, the pin comprising a pin body inserted into the pinhole, a key protrusion having a shape corresponding to the key groove, and a rotational handle at one end portion of the pin body.

2. The container of claim 1, wherein, when the mobile post is completely lowered, the support bar is folded to be in parallel to said fixed plate.

3. The container of claim 1, wherein an actuator is installed at said another end portion of the support bar so that the mobile post automatically ascends or descends as the position of said another end portion of the support bar changes.

4. The container of claim 1, wherein the fixed post and the wall plate are hinge-coupled to the bottom plate to be capable of being erected or reclined with respect to the bottom plate and an actuator for erecting or reclining the fixed post and the wall plate.

5. The container of claim 4, wherein the actuator comprises:

a hydraulic jack fixed to the bottom plate and extending and contracting a piston by using an elevating motion of a detachable lever, and a pressing rod having one end portion hinge-coupled to the bottom plate, a middle portion hinge-coupled to an end portion of the piston, and another end portion contracting the fixed post, and pressing and erecting the fixed post as the piston extends.

6. A container for a ship, said container capable of adjusting its height and comprising:

a bottom plate on which goods are placed;

a wall plate installed to erect on the bottom plate at one side;

a fixed post installed at the wall plate;

a mobile post installed at the fixed post and capable of ascending and descending by being guided by the fixed post over a predetermined length with respect to the fixed post; and a support bar having one end portion hinge-coupled to the mobile post and another end portion fixed to the wall plate to support the mobile post at an angle;

wherein the fixed post and the wall plate are hinge-coupled to the bottom plate to be capable of being erected or reclined with respect to the bottom plate, and an actuator for erecting or reclining the fixed post and the wall plate;

wherein a hydraulic jack is fixed to the bottom plate and extends and contracts a piston by using an elevating motion of a detachable lever; and wherein a pressing rod is provided having one end portion hinge-coupled to the bottom plate, a middle portion hinge-coupled to an end portion of the piston, and another end portion contacting the fixed post, and pressing and erecting the fixed post as the piston extends.

* * * * *